United States Patent [19]

Di Fazio

[11] 4,304,027

[45] Dec. 8, 1981

[54] HORIZONTALLY ADJUSTABLE DOOR HINGE

[75] Inventor: Joseph Di Fazio, Troy, Mich.

[73] Assignee: Acorn Building Components, Inc., Detroit, Mich.

[21] Appl. No.: 119,126

[22] Filed: Feb. 6, 1980

[51] Int. Cl.[3] ..... E05D 7/04

[52] U.S. Cl. ..... 16/130; 16/131

[58] Field of Search ..... 16/130, 131

[56] References Cited

U.S. PATENT DOCUMENTS

| | | | |
|---|---|---|---|
| 2,027,888 | 1/1936 | Solomon | 16/130 |
| 2,330,455 | 9/1943 | Steckel | 16/131 |
| 2,441,221 | 5/1948 | Eckel | 16/130 |
| 3,182,351 | 5/1965 | Kaufman et al. | 16/130 |

*Primary Examiner*—Doris L. Troutman

*Attorney, Agent, or Firm*—Cullen, Sloman, Cantor, Grauer, Scott & Rutherford

[57] ABSTRACT

A horizontally adjustable door hinge, for hingedly connecting the vertical edge of a door to the adjacent vertical edge of the door frame, is secured upon an elongated metal strip which forms one of said edges. An enlarged opening cut in the strip loosely receives one leaf of the hinge. A plate overlaps the opening at the rear surface of the strip, and, the plate rear surface is overlapped by a back-up plate. The plate is rigidly fastened to the strip rear surface, and the back-up plate is secured to the plate by a mechanical fastening means that permits horizontal movement of the back-up plate relative to the fixed position plate. A number of sets of aligned screw receiving holes are formed in the leaf, plate and back-up plate. The holes in the plate are formed as horizontally elongated slots. At least some of the holes in the back-up plate are threaded, while others are of sufficient diameter to loosely pass a screw therethrough. Short screws extend through the aligned holes which include the threaded holes and when tightened, fasten together the leaf, plate, and back-up member. When the screws are loosened, the leaf, together with the back-up plate, may be horizontally moved relative to the plate and the strip. Other long screws extend through the other holes for embedding within a door or frame substrate, upon which the strip is applied, after the leaf is horizontally adjusted to predetermined location.

4 Claims, 5 Drawing Figures

HORIZONTALLY ADJUSTABLE DOOR HINGE

BACKGROUND OF INVENTION

The invention herein relates to an improved hinge system for use in prefabricated door and frame assemblies. Such assemblies conventionally comprise a door which is surrounded by and hingedly connected to a metal frame. The door, with the frame, is inserted into a doorway or door opening, as a unit. Such assemblies are commonly used in both new constructions of homes and the like buildings, as well as for replacements of existing door and door frames.

One of the problems encountered in the building construction industry is that doorways frequently are out of plumb, that is, the jambs, header and sill sections of the frame may be out of square alignment. Sometimes this comes about in a new building because of inaccurate measurements. Sometimes this takes place in an existing structure due to settling, shifting of the structure, etc.

In any event, where a complete door and frame assembly is to be inserted in a pre-existing doorway which is out of alignment, it is desirable to provide some means for aligning the door vertically, even though the door may then be slightly out of alignment with the door frame to which it is connected. That is, visually a door which is out of vertical alignment or out of plumb, is unacceptable. Vertically aligning a door is normally a very difficult, time-consuming carpentry task.

Various systems have been attempted to provide for adjustments of the door relative to the prefabricated door frame to which it is assembled. By way of example, the patent to Kempel, U.S. Pat. No. 3,690,037 issued Sept. 12, 1972 for a "Prefabricated Door and Frame Assembly" discloses, in general, the type of door and frame assembly to which the invention herein relates. The invention of this application is concerned with an improved system of adjusting one of the hinge leaves in a horizontal manner so as to preserve the vertical position of the door, relative to the frame, at all times, but meanwhile, permitting adjustment to compensate for misalignment.

SUMMARY OF INVENTION

The invention herein contemplates cutting an enlarged opening in the face of the prefabricated metal door frame into which one leaf of the hinge is loosely positioned. A vertically elongated plate is arranged upon the rear surface of the strip to overlap the opening. The upper and lower ends of the plate are secured permanently to the strip, as by welding. A rear, back-up plate overlaps the central portion of the plate and is secured to the plate by a mechanical fastener which permits the back-up plate to move horizontally only.

Aligned sets of holes are formed in the leaf, plate central portion and back-up plate, with the holes in the plate central portion being horizontally elongated slots. Some of the holes in the back-up plate are threaded. Short screws extend into the threaded holes of the back-up plate, through their aligned slots and through the aligned holes in the leaf so that when these screws are tightened, the leaf, plate and back-up plate are all tightly clamped together. When these screws are loosened, the hinge leaf, together with the back-up plate, may be moved horizontally only relative to the plate for horizontal adjustment of the hinge, and consequently of the door. The engagement between the horizontal slots and the screws function to hold the hinged door from gravity dropping down out of its prefabricated horizontal alignment in the frame when the hinge adjustments are made.

Additional holes in the back-up plate are non-threaded so as to receive wood screws which extend through the aligned holes and into the substrate, i.e., the wood door framing or jamb upon which the metal frame is positioned.

Although the metal strip is described as forming the vertical edge of the surrounding metal frame which makes up the assembly, it could be reversed. That is, the metal strip could be formed on the edge of the door so that the leaf connected to the door is horizontally adjustable. Otherwise, the leaf connected to the door is secured to the door edge in the conventional manner, using fixed position wood screws.

An object of this invention is to permit the horizontal adjustment of the several hinges that are typically used on a door-metal frame assembly so that the door itself may be warped or bowed or re-aligned for visual alignment Once the hinges are appropriately horizontally aligned, the tightening of the wood screws secures the hinges and the metal strip to the wood substrate to prevent movement thereof relative to the door frame substrate.

Another object of this invention is to provide a simple, inexpensive, horizontally adjustable hinge system for use with door-metal frame assemblies which can be applied in a building structure with minimum time, tools and relatively unskilled labor. Thus, the assembly permits a considerable reduction in the expenses of construction.

These and other objects and advantages of this invention will become apparent upon reading the description, of which the attached drawings form a part.

DETAILED DESCRIPTION

Figures 1, 2, 3, 4, 5:
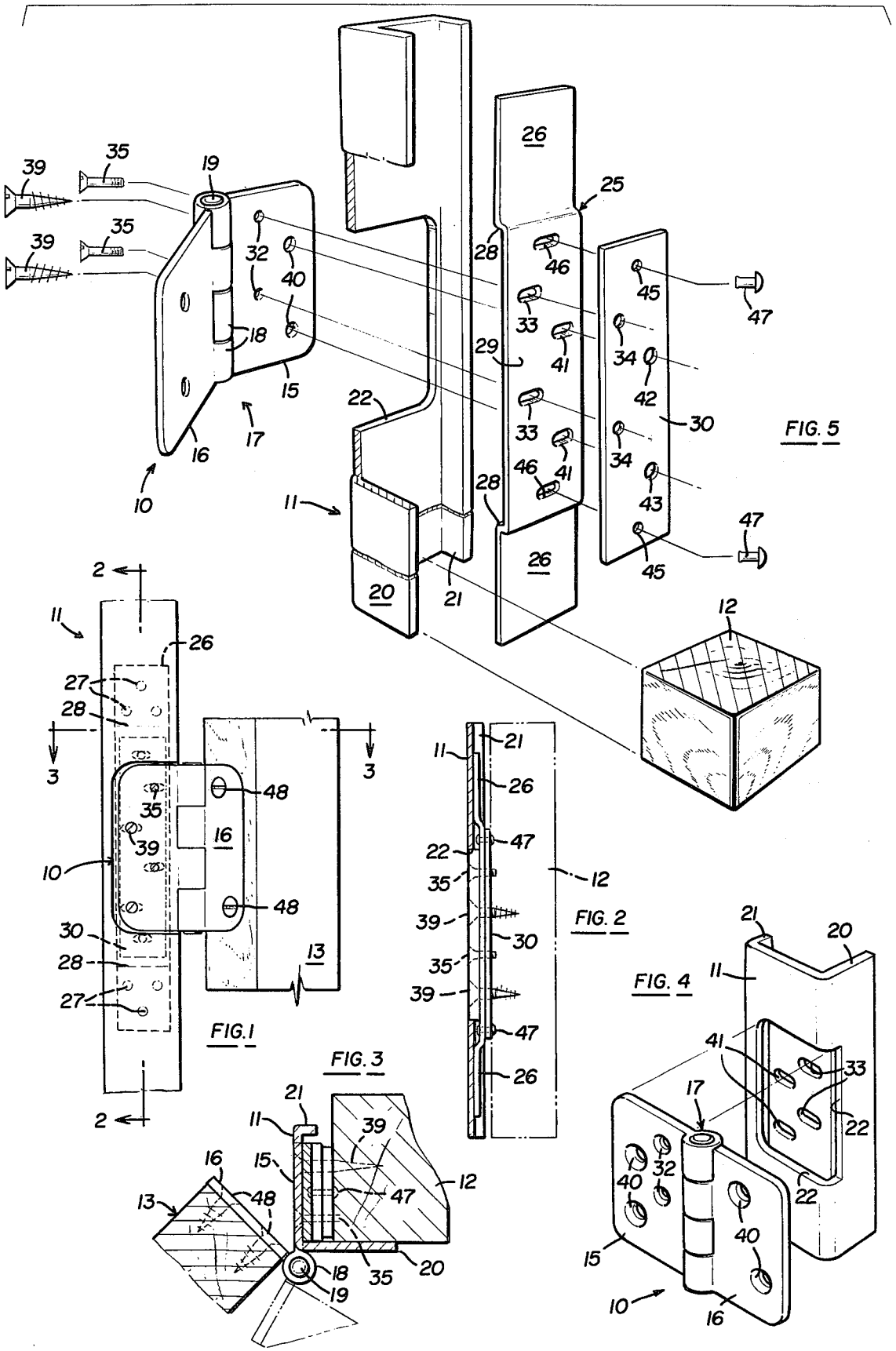
FIG. 1 is a fragmentary, elevational view of a portion of a metal frame, and a portion of a door, with the two shown as hinged together.
FIG. 2 is a cross-sectional view taken in the direction of arrows 2—2 of FIG. 1.
FIG. 3 is a cross-sectional plan view taken in the direction of arrows 3—3 of FIG. 1.
FIG. 4 is a perspective view of a portion of the frame with the hinge removed therefrom.
FIG. 5 is a disassembled view of the parts which make up the frame-door-hinge assembly.

Referring to the drawings, the hinge 10 is to be fastened to the jamb-like frame member 11, which is a vertical, thin-guage, but rigid metal strip. The metal frame, in turn, is secured to the wood jamb or doorway or substrate 12 into which the assembly is positioned. The hinge pivotally connects a typical door 13 to the frame. Ordinarily, three such hinges are used and the hinges are pre-assembled to the frame and door so that these are handled as a unit. For illustration purposes, only one such hinge is shown.

The hinge 10 includes a horizontally adjustable leaf 15 and a fixed leaf 16 with a conventional pivot 17 comprising intermeshed hinge knuckles 18 through which the hinge pin 19 is inserted.

The frame member 11 is preferably formed in a generally channel-like shape with a forward or exposed wide cover flange 20 which forms the corner of the doorway, and a short, rear flange 21.

An opening 22 is cut in the strip to receive the adjustable leaf 15. The opening is of greater width than the leaf so that the leaf may be horizontally adjusted.

A vertically elongated, narrow, plate 25 is arranged on the rear or covered surface of the strip and overlaps the opening 22 with its central portion. The upper and lower flat end portions of the plate are rigidly secured to the strip as by means of welds 27. Rearward bends 28 are formed in the plate to provide a flat, central portion 29 which overlaps the opening 22 and is spaced rearwardly, relative to the plane of the strip, a sufficient distance to receive the leaf of the hinge and position the leaf so that its exposed face is coplanar with the strip exposed face.

An elongated back-up plate member 30 is arranged in face-to-face contact with the central portion 29 of the plate 25.

Adjustment screw holes are formed in the leaf 15. Aligned horizontal slots 33 are formed in the plate 25. These, in turn, are aligned with threaded holes 34 formed in the back-up plate 30. Thus, short adjustment screws 35 extend through the holes 32 and the horizontal slots 33 and are threadedly engaged within the holes 34. When these screws are tightened, the leaf, plate and back-up plate are clamped tightly together and are rigidly positioned in horizontal adjusted location. When the screws are loose, the leaf, together with the back-up plate, may be moved horizontally relative to the plate 25 and the strip 11 to which the plate is rigidly connected.

Once the leaf is horizontally positioned in its desired location, elongated wood screws 39 extend through wood screw holes 40 in the leaf 15, through aligned horizontal slots 41 in the plate 25 and through screw passing holes 42 in the back-up plate 30 to enter into the wood substrate 12. This locks the members against movement out of adjustment. Ordinarily, the metal frame is additionally fastened by screws to the substrate so that the mechanical fastening of a number of screws through the frame, including the wood screws 39, maintain the predetermined horizontal adjustment of the leaf 15 and therefore, of the door.

The back-up plate is secured to the elongated plate by a mechanical fastening means which permits only horizontal movement of the back-up plate. This comprises rivet holes 45 formed in the back-up plate 30 near its upper and lower ends. Aligned horizontal elongated slots 46 are formed in the plate 25. Rivets 47 or similar mechanical fastening means secure the back-up plate through the plate 25.

The fixed leaf 16 of the hinge is secured to the door vertical edge by means of conventional flathead wood screws 48, as illustrated in FIGS. 1 and 3. Where the door itself is made of a metal frame which surrounds a core, the door frame strip may be formed with the opening and receive the hinge leaf in the same manner as described above in connection with the frame strip. In that case, the fixed leaf on the hinge would be rigidly fastened to the frame.

Having fully described an operative embodiment of this invention, I now claim:

1. A horizontally adjustable hinge system for hingedly connecting the vertical edge of a door to a vertical frame edge, comprising:

a vertically elongated, flat metal strip forming one of said edges and having an exposed face and a rear face, with said strip having a vertically elongated opening formed therein;

a hinge having a flat leaf loosely fitted within said opening and arranged generally in the plane of the strip, and a second leaf pivotally connected to said flap leaf and adapted for securement to the other of said edges;

a vertically elongated plate overlapping said opening and having end portions overlapping and rigidly secured to the strip portions immediately above and below the upper and lower ends of the opening;

and with the plate being arranged so that its central portion, which overlaps the strip opening, is substantially flat, and parallel to the strip for face-to-face contact with said flat leaf;

a flat, back-up plate member of about the same size as, and overlapping in face-to-face contact, the rear face of the plate;

means fastening said back-up plate member to said plate for providing limited horizontal movement only of said back-up plate member relative to said plate;

a number of screw holes formed in the leaf, and corresponding horizontally elongated slots formed in said plate in alignment with each screw hole, and aligned screw receiving openings formed in the back-up plate member;

short screws extending through certain of the leaf screw holes and through their aligned plate horizontal slots and being screw threaded within their aligned back-up plate member screw holes, for screw fastening the leaf to the back-up plate member, so that loosening of such screws permits horizontal movement only of the leaf relative to the plate and said strip.

2. A hinge system as defined in claim 1, and including elongated screws normally extendable through the remaining leaf screw holes for extending through their aligned horizontally elongated plate slots and extending completely through their aligned screw holes formed in the back-up plate member for embedding within a support substrate upon which the strip is arranged.

3. A hinge system as defined in claims 1 or 2, and said means for fastening said plate member to said plate comprising at least one hole formed in one and a horizontally elongated slot formed in the other, and a rivet-like mechanical fastener extending through the hole and slot to fasten the back-up plate member and the plate together for relative horizontal sliding motion.

4. A hinge system as defined in claim 1, and said plate being bent rearwardly relative to the strip above and below its central portion so that said central portion is spaced rearwardly a short distance relative to the plane of the strip rear face for aligning the exposed forward face of the leaf with the exposed forward face of the strip.

* * * * *